US012281574B2

(12) United States Patent
Robes et al.

(10) Patent No.: US 12,281,574 B2
(45) Date of Patent: Apr. 22, 2025

(54) SEALING PROFILE FOR CONCRETE TUBBING

(71) Applicant: Sealable Solutions GmbH, Waltershausen (DE)

(72) Inventors: David Robes, Erfurt (DE); Oliver Pasemann, Sontra (DE)

(73) Assignee: Sealable Solutions GmbH, Waltershausen (DE)

( * ) Notice: Subject to any disclaimer, the term of this patent is extended or adjusted under 35 U.S.C. 154(b) by 373 days.

(21) Appl. No.: 17/781,798

(22) PCT Filed: Dec. 1, 2020

(86) PCT No.: PCT/EP2020/084140

§ 371 (c)(1),
(2) Date: Jun. 2, 2022

(87) PCT Pub. No.: WO2021/110686

PCT Pub. Date: Jun. 10, 2021

(65) Prior Publication Data

US 2023/0003301 A1 Jan. 5, 2023

(30) Foreign Application Priority Data

Dec. 4, 2019 (DE) ..... 10 2019 133 062.9

(51) Int. Cl.
*E21D 11/38* (2006.01)
*E04B 1/68* (2006.01)

(52) U.S. Cl.
CPC ..... *E21D 11/385* (2013.01); *E04B 1/6813* (2013.01)

(58) Field of Classification Search
CPC ..... F16J 15/02; F16J 15/027; E21D 11/385; E04B 1/6813
(Continued)

(56) References Cited

U.S. PATENT DOCUMENTS 4,449,720 A * 5/1984 Wolters ..... F16L 27/1025 277/625
4,483,544 A 11/1984 Faerber et al.
(Continued)

FOREIGN PATENT DOCUMENTS

DE 2833345 A1 2/1980
DE 3934198 A1 4/1991
(Continued)

OTHER PUBLICATIONS

International Search Report issued on Mar. 17, 2021, in International Application No. PCT/EP2020/084140.

*Primary Examiner* — Sunil Singh
(74) *Attorney, Agent, or Firm* — Stephan A. Pendorf; Patent Central LLC

(57) ABSTRACT

A sealing profile for embedding in a moulded part made of curable material. Spalling observed in practice, which occur, in particular, at corners of tubbings in the area with an integrated seal, can be effectively prevented or at least reduced by using a sealing profile where the flanks of the profile base, which is embedded within the moulded part, e.g., concrete tubbing, merge with rounded portions or chamfers into the profile base face. In addition, the at least one anchoring foot is located within the profile base face and thus outside the area of the rounded portions.

19 Claims, 3 Drawing Sheets

Figure 1:
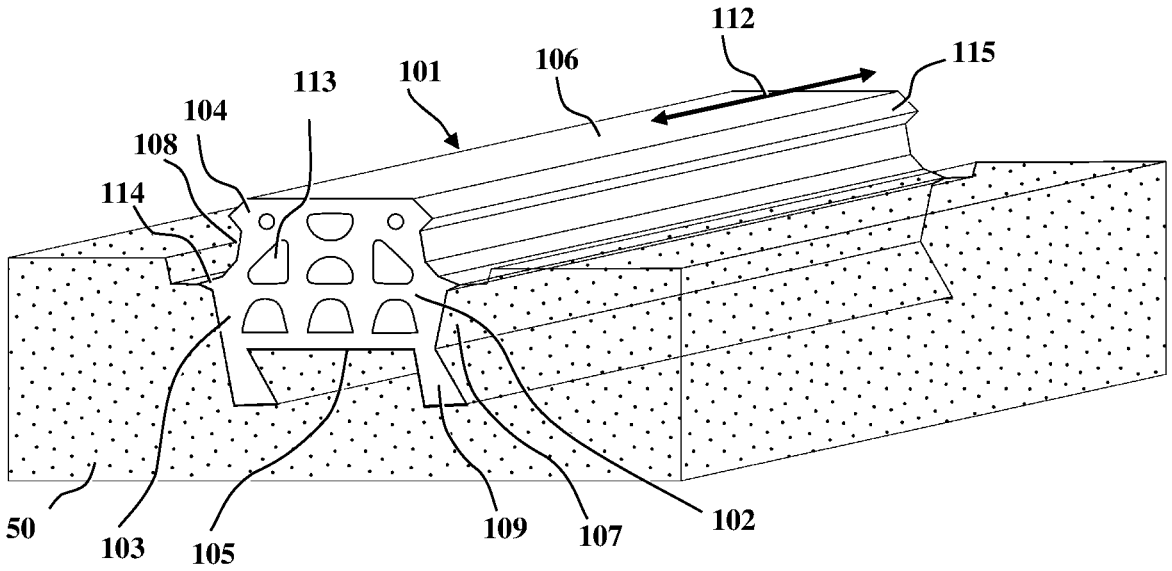
Fig. 1 (prior art)

(58) Field of Classification Search
USPC .... 277/921, 645, 649, 605, 606; 404/64, 65; 52/396.04, 396.05, 396.06
See application file for complete search history.

(56) References Cited

U.S. PATENT DOCUMENTS

| | | | | |
|---|---|---|---|---|
| 4,762,441 | A * | 8/1988 | Glang | F16L 9/22 277/645 |
| 2003/0168819 | A1 | 9/2003 | Gutschmidt | |
| 2019/0226202 | A1 | 7/2019 | Andrick et al. | |
| 2019/0226340 | A1* | 7/2019 | Andrick | E04B 1/6813 |

FOREIGN PATENT DOCUMENTS

| | | | |
|---|---|---|---|
| DE | 4218710 | C1 | 11/1993 |
| DE | 19841047 | C1 | 1/2000 |
| DE | 10310856 | A1 | 9/2004 |
| DE | 102007032236 | A1 | 1/2009 |
| EP | 0982472 | A1 | 3/2000 |
| EP | 1192028 | B1 | 3/2004 |
| EP | 1003955 | B1 | 8/2005 |
| GB | 2541978 | A | 3/2017 |
| WO | 0153657 | A1 | 7/2001 |

* cited by examiner

SEALING PROFILE FOR CONCRETE TUBBING

The invention relates to a sealing profile for embedding into a moulded part made of curable material, in particular, a concrete or plastic moulded part, as well as a moulded part and a sealing arrangement with the sealing profile.

Shaft and tunnel structures are regularly composed of individual monolithic prefabricated components (e.g., tubbings), between which there are contact joints that are sealed with suitable seals, for example, to prevent the penetration of a surrounding medium (e.g., water). The production of such prefabricated components is usually carried out with the aid of formwork moulds, such as those known from DE 4218710 C1, DE 10 2007 032 236 A1 or DE 19841047 C1. A curable material, e.g., concrete, is poured into the formwork mould, which is opened and removed after the material has hardened.

Seals for sealing the contact joints can subsequently be arranged in designated circumferential grooves in the joint sides of the cured moulded part. An example of such a seal is described in DE 2833345 A1.

Often, however, seals that are required to seal the joints, which are later formed when the prefabricated components are assembled into a shaft or tunnel, are already integrated into the prefabricated components during casting by pouring and anchoring them. Such seals are also referred to as integrated seals or anchored seals. Such integrated seals, which are intended for embedding into prefabricated components made of curable material, such as pipes, tubbings, shaft rings and the like, are usually provided at their base with so-called anchoring feet, which are enclosed by the curable material when casting the prefabricated component and are intended to reliably hold the seal within the cured prefabricated component. In addition, such seals are regularly equipped with projections or the like, with the aid of which they can be arranged in a suitably designed mounting of a formwork mould and held during the casting process in such a way that the seal with its anchoring feet points in the direction of the formwork mould interior and can be embedded into the curable material. A formwork system and an integrated seal are described in WO 01/53657 A1 and in EP 1003955 B1. Integrated seals are also known from the DE 3934198 A1 and GB 2541978 A. US 2019/0226202 A1 describes an integrated seal equipped with anchoring elements projecting from the side of the sealing body, which can be removed from the concrete body in the event of damage, for example, and be replaced with a new seal.

In the case of prefabricated parts, e.g., tubbings, with the integrated seals known in prior art, spalling of the curable material e.g., concrete, occurs again and again, in particular, during the installation or assembly of the finished parts.

The object of the present invention is to reduce the risk of spalling when installing or assembling prefabricated parts with integrated sealing profiles.

To solve the task, the invention provides for a sealing profile to be embedded into a moulded part of curable material, in particular, a concrete or plastic moulded part, wherein the sealing profile has a profile body, comprising (a) a profile base to be embedded into the moulded part, which comprises a profile base face facing the moulded part after embedding the sealing profile and lateral profile base flanks; and b) a profile back projecting from the profile base which comprises a profile-back face opposite the profile base face and lateral profile-back flanks, and wherein, the sealing profile comprises at least one anchoring foot projecting from the profile base face, and the profile base flanks merge into the profile base face with rounded portions or chamfers.

The spalling observed in practice, which occur, in particular, at corners of tubbings in the area with an integrated seal, can be effectively prevented or at least reduced by using a sealing profile according to the invention. In the sealing profile according to the invention, the flanks of the profile base, which is embedded within the moulded part, e.g., concrete tubbing, merge with rounded portions or chamfers into the profile base face. In other words, the sealing profile comprises rounded or chamfered corners or edges in the area of the profile base. In addition, the at least one anchoring foot is located within the profile base face and thus outside the area of the rounded portions and is thus offset from the edge area of the profile base face towards the profile interior compared to conventional sealing profiles, such as those known from WO 01/53657 A1.

Without wanting to be bound to a particular theory, it is assumed that a better distribution of forces can be achieved by the rounded portions or chamfers and the at least one inwardly offset anchoring foot and a weakening of the moulded material, e.g., the concrete, can be avoided.

A "moulded part made of curable material" is understood here as a component that is produced by means of a mould that at least essentially specifies the later shape of the moulded part, into which a curable material is poured and passively or actively cured. For example, the moulded part can be a tunnel tubbing.

A "tubbing" is understood to mean prefabricated components of the outer shell of tunnels, shafts, pipes, etc. It can be, for example, ring-segment or ring-shaped components, e.g., made of concrete.

A "curable material" is understood here as an initially flowable but later curing material, which hardens under normal conditions by itself or under the external influence of heat, UV light, etc. for example. This may be, for example, concrete, synthetic resin, adhesive and the like. This may also be, for example, a fibrous synthetic resin that hardens to a fibre-reinforced plastic, for example GRP.

By "sealing profile", a preferably strand-shaped, where applicable, frame-like or ring-shaped closed, elastomer profile with sealing function is understood, for example, a tubbing seal, concrete or plastic pipe seal or shaft seal.

An "elastomer profile" is a sealing profile made of elastomer material. Examples of suitable elastomer materials are natural rubber (NR), styrene-butadiene rubber (SBR), butyl rubber (IIR), ethylene-propylene rubber (EPDM), butadiene-acrylonitrile rubber (NBR), hydrogenated acrylonitrile rubber (HNBR), chloroprene rubber (CR), chlorosulfonated polyethylene (CSM), polyacrylate rubber (ACM), polyurethane rubber (PU), silicone rubber (Q), fluorosilicone rubber (MFQ) and fluororubber (FPM). EPDM, SBR, CR or NBR, are preferred, with EPD M being particularly preferred, wherein the elastomer material may have, for example, a shore hardness of 60-80 (type D in accordance with DIN EN ISO 868). The term also includes profiles made of thermoplastic elastomer (TPE) or profiles made of mixtures of elastomers, for example, the one mentioned above. A sealing profile can also consist of different elastomer materials in some areas. For example, the back part of a tubbing profile, i.e., the profile area with which the profile is inserted into a formwork mould, may consist of a different, for example harder, elastomer material than the base of the profile, or vice versa. Profiles that have areas of different elastomer materials may be produced, for example, by coextrusion.

The term "integrated seal" is understood here to mean a sealing profile which is intended for embedding into a moulded part made of curable material and designed accordingly, e.g., equipped with at least one anchoring foot or other devices for embedding the sealing profile in the curable material.

An "anchoring foot" is understood here as a profile projection that protrudes into the later moulded part and causes a frictional connection or preferably a positive-locking fit between profile and moulded part, so that the profile is attached to or in the cured moulded part in such a way that it can not be removed without damage to the moulded part and/or the profile (e.g., by tearing off the profile projection). For this purpose, the profile projections may be, for example, in a dove-tail-like manner, generally with a cross-section increasing towards the projection end or other anchoring geometries. The term "increasing cross-section" refers to the fact that a profile projection comprises a larger cross-section towards the free, i.e., off-profile, end, i.e., it expands or thickens along its extension.

The term "strand-shaped" in relation to a sealing profile means that the sealing profile forms an oblong, essentially linear profile strand. An example of regularly strand-shaped sealing profiles includes tubbing seals, which are arranged in grooves along the end sides of tubbings. The ends of strand-shaped sealing profiles may, where applicable, be joined together to form a frame or ring, wherein corner elements can also be used between linearly formed sections, which may be designed differently than the rest of the sealing frame.

The expression here according to which the "profile base flanks merge with rounded portions or chamfers into the profile base face" refers to a bent, curved or, in the cross-section, polygonal progression of the profile base flanks to the profile base face and to a central profile axis perpendicular to the profile base face so that the profile base, in the transition area in which the profile flanks merge into the profile base face with rounded portions or chamfers, tapers in cross-section towards the profile base face, or, in other words, a profile base with rounded or chamfered corners or edges is formed. The rounded portions describe in the cross-section a curved arc, for example a circular arc or a curved arc composed of a circular arc and a transition curve. The term "chamfer" or "bevel" here includes multiple chamfers, i.e., polygonal transitions in the cross-section. The rounded portions or chamfers are understood here as part of the profile base flanks. For the expression "with rounded portions or chamfers", the expression "rounded or chamfered", "rounded off or chamfered off" or "with rounded portions or bevels" can also be used, wherein the terms "bevel", "chamfer" or "chamfered" each include multiple chamfered portions, i.e., a polygonal course of the transition area in the cross-section. The formulation that the "profile base flanks merge into the profile base face with rounded portions or chamfers" also includes mixed shapes, i.e., alternating rounded and chamfered portions in a transition area of a profile base flank or chamfered transitions on one side of the profile and rounded transitions on the other side of the profile. Changing, transition areas, for example regularly alternating ones, are also included in the longitudinal direction of a stripe-shaped profile with regard to rounded portions or chamfered portions.

The term "profile body" is understood to mean the trunk of a sealing profile to which projections, lips or anchoring feet may be attached where applicable. Profile bodies, projections, lips and anchoring feet are preferably formed as a single piece. For example, a single-piece sealing profile including a profile body, an anchoring foot and, where applicable, projections, lips and the like, can be made of an elastomer material by means of extrusion. However, it is also possible that, within a single-piece sealing profile, there are areas made of different materials, for example, elastomer materials of different hardness for the profile base and the profile back. Such sealing profiles can be produced, for example, by means of coextrusion.

Here, the term "profile base" refers to the part of the sealing profile that, after its anchoring, is turned towards the moulded part and embedded within the moulded part, i.e., surrounded or enclosed by cured material.

The term "profile base face" here refers to the area of the outer face of the profile base between the rounded portions, which is turned towards the moulded part in the installation situation. The profile base face may, for example, be planar.

Here, the term "profile back" refers to the part of the sealing profile that remains free in the moulded part after its embedding and is not surrounded or framed by cured material.

The "profile-back face" refers to the outer face of the profile back, which is essentially opposite to the profile base face of the sealing profile, and which provides the sealing face in the finished moulded part, which, for example, in the case of tubbings for tunnel construction, lies on the profile-back face of a sealing profile in an adjacent moulded part.

The term "profile flank" here refers to lateral areas of the sealing profile between the profile base face and the profile-back face. The term "profile base flank" refers to the flanks of the profile base, the term "profile-back flank" to the flanks of the profile back.

When the terms "above" or "below" are used here, they refer to the orientation of the sealing profile with the profile back up, i.e., away from the moulded part, and with the profile base to "down", i.e., towards the moulded part. "Above" therefore means offset in the direction of the profile-back face, "below" in the direction of the profile base face.

In a preferred embodiment, the profile base flanks run parallel to each other in the direction of the profile base face or run towards each other in the direction of the profile base face before they merge into the rounded portions or chamfers at a first transition point. In this upper area, i.e., the area of the profile base lying towards the profile back, the profile base flanks preferably run in the direction of the profile base face towards each other, preferably in a straight line. In this preferred embodiment, the profile base runs conically in the cross-section towards the profile base face, so that the profile base tapers in the direction of the profile base face. This makes it easier to enclose the profile base when casting the moulded part without creating cavities. The angle β between the course of the profile base flank in the cross-section of the sealing profile before its transition into the rounded portions or chamfer, i.e. in the direction of the profile base face in front of the first transition point, and a vertical standing on the profile base face can be, for example, 3-20°, 5-20°, 5-15°, 5-10° or 5-9°.

The corners or edges of the profile base are preferably rounded or chamfered so that they do not protrude laterally from the profile body. The corners or edges of the profile base should have no anchoring function in the sealing profile according to the invention. Preferably, the corners are also do not protrude in a vertical direction over the profile base face in the direction of the moulded part. The rounded portions or chamfers therefore preferably run in the cross-section of the sealing profile from a first transition point in a curved (for rounded portions) or polygonal (for chamfers)

line to a central profile axis perpendicular to the profile base and merge into the profile base face at a second transition point. The rounded portions or chamfers are preferably laterally not projecting from the profile body. When passing through the rounded portions or chamfered portions from the first transition point in the direction of the second transition point, the direction of the rounded portions characterizing the rounded portions or the traverse comprising the chamfers thereby always changes only with respect to the central profile axis. In the case of circular-arc-shaped rounded portions and planar profile-flank faces above the rounded portions and a planar profile base face, the profile-flank faces run above the rounded portions and the profile base face in the cross-sectional view preferably in the direction tangential to the respective ends of the circular arc. In the cross-section, the profile-flank face above the rounded portions therefore runs tangentially to the first transition point and the profile base face tangentially to the second transition point. Rounded portions can also be composed in the cross-section of a circular arc and one or two transition curves, for example, a transition curve from a transition point on the profile base flank to the circular arc and another transition curve to the transition point on the preferably planar profile base face. As transitional curves, clothoids, sinusoids, cubic parabolas or Bloss-curves can be used for example.

In preferred embodiments of the sealing profile according to the invention, the curved arc of the rounded portions extends across a maximum of 90°, preferably less than 90°. Preferably, the curved arc extends over at least 30°, at least 35°, 40°, 45°, 50°, 55° or at least 60°. The formulation according to which the curved arc of the rounded portions extends over x°, means, for example, that the angle between the radii of a curvature circle (osculating circle) at the curved arc leading to the ends of the curved arc is x°.

For example, the rounded portions can be circular-arc-shaped in the cross-section, at least in sections. Other geometries are also conceivable in principle. The radii of circular-arc-shaped rounded portions can be in a tubbing seal, for example, between 2 and 12 mm, preferably 2-8 mm, 3-6 mm, 3-5 or 3-4 mm. As already indicated above, a curved arc, viewed in the cross-section of the profile, can also be composed of a circular-arc section and one or a plurality of transition curves.

In the case of chamfered portions, it is preferred to provide as many chamfers as possible, i.e., as many steps of chamfered portions as possible with corresponding changes of direction, in order to obtain a smooth transition into the profile base face. It may, for example, be preferred to provide at least two, preferably at least three, at least four, at least five, or at least six individual chamfers for the transition area.

In the sealing profile according to the invention, it is preferred if the ratio of the length of the curved arc of the rounded portions, which may be composed, for example, of a circular arc and one or two transition curves, to the length of the profile base face, or the ratio of the total length of the chamfer to the length of the profile base face in the cross-section is 1:5 to 1:8, preferably 1:5.5 to 1:7.5, or 1:6 to 1:7.3. The data refer to the ratio of the length of the curved arc of one of the rounded portions or the length of the chamfer on one side of the profile, seen in the cross-section, i.e., the traverse characterizing the chamfer in the cross-section, to the total length of the profile base face, also seen in the cross-section.

In the event that only one anchoring foot is present, this is preferably centrical from the profile base face and is accordingly distanced away the rounded or chamfered corners. However, a non-centrically arranged anchoring foot can also be provided, which, however, is then, in any case, also distanced from the rounded or chamfered corners, i.e., the rounded portions or chamfers, in the direction of the central profile axis. In a preferred embodiment, however, the sealing profile comprises two or more, preferably two, anchoring feet distanced away from each other, thereby projecting away from the profile base face, wherein the anchoring feet are distanced away from the transition points of the rounded portions or chamfers in the profile base face in the direction of the profile body, i.e., in the direction of the central profile axis. In this preferred embodiment, the anchoring feet extending from the profile base face in the direction transverse to the profile base face are distanced away from the rounded or chamfered corners, i.e., inwardly offset towards the central profile axis. This embodiment according to the invention, in which, in comparison to profiles from prior art, the anchoring feet are shifted further inwards to the centre of the profile, is particularly favourable for the prevention of spalling, which are caused by weakening of the curable material, e.g., concrete, in the area of the anchoring feet. The expression "extending in the direction transverse to the profile base face" includes anchoring feet orthogonally on the profile base face but also angled anchoring feet, i.e., anchoring feet that stand at an angle different from a right angle on the profile base face.

In embodiments of the sealing profile according to the invention, in which air- or gas-filled longitudinal channels are arranged in the profile body, the starting points of the anchoring feet on the profile base face, i.e., the origins of the anchoring feet on the profile base face, each are preferably in areas of the profile base face, above which no longitudinal channels are directly arranged in the profile body so that the anchoring feet crop out from areas of the profile base face, above which solid profile areas are present, which preferably form solid bars of profile material in the profile body, which extend at least through a part of the profile body, preferably at least through the profile base in the direction of the profile-back face.

The at least one anchoring foot can, for example, expand in the cross-section in a dove-tail-like manner or with a different geometry in the direction of the profile base face in order to enable anchoring in the later moulded part. The at least one anchoring foot is preferably axisymmetric in the cross-section. However, other geometries are also possible. The at least one anchoring foot may also comprise projections, recesses, undercuts and the like to improve anchoring.

The sealing profile according to the invention is preferably axisymmetric in the cross-section in relation to a central profile axis perpendicular to the profile base face. This preferably applies including the anchoring feet and any longitudinal channels. However, an axisymmetric embodiment is not required. Other suitable embodiments for anchoring are also possible.

The sealing profile according to the invention is preferably strand-shaped, i.e., it extends in a strand-shaped manner in a longitudinal direction. Such a strand-shaped sealing profile is particularly suitable for tunnel tubbings or shaft rings. Four such strand-shaped sealing profiles can, for example, be connected together with profile corners in a known manner to a ring-shaped closed four-sided sealing frame, which can be integrated into the four front sides of a tubbing.

The sealing profile according to the invention preferably comprises hollow longitudinal channels running in the profile body. In the case of a strand-shaped sealing profile, the longitudinal channels extend in the longitudinal direction of the sealing profile. These are areas of the profile that are kept free of profile material and, for example, filled with air. The sealing profile is more compressible in the area of the channels and the channels can therefore be used, among other things, to adjust the hardness of the profile.

In a particularly preferred embodiment of the sealing profile according to the invention, the profile body has a generally hexagonal cross-section. This embodiment is particularly well suited for tunnel tubbings. Two sides of the hexagon are formed by the profile base face and the opposite profile-back face, which is preferably parallel to the profile base face. The remaining sides of the hexagon are formed by the profile base flanks and the profile-back flanks. The profile-back flanks can extend, in relation to the cross-section of the sealing profile, from the profile-back face towards the profile base face with an expanding cross-section, i.e., divergent, while the profile base flanks extend towards each other towards the profile base face. The profile base flanks can initially be essentially linear in the cross-section before they transition into the profile base face with rounded portions or chamfers. At the level of the transition between the profile base flanks and the profile-back flanks, sealing lips may be arranged that protrude laterally from the profile body. These sealing lips have a sealing function when casting the moulded part and are intended to prevent the curable material from penetrating into the seat of the sealing profile in the formwork mould.

The sealing profile according to the invention preferably consists of an elastomer material, preferably EPDM, SBR, CR, NBR or TPE, preferably EPDM, wherein the elastomer material preferably has a shore hardness of 60-80 (type D according to DIN EN ISO 868).

In a second aspect, the invention also relates to a moulded part made of curable material comprising a sealing profile according to the invention embedded in the moulded part with the profile base. The moulded part is preferably a concrete or plastic moulded part, preferably a concrete blade for tunnel construction, a concrete ring for shaft construction, a concrete pipe for sewer or pipeline construction or a plastic pipe, preferably a GRP pipe.

In a third aspect, the present invention also relates to a sealing arrangement comprising at least one moulded part made of curable material, in particular, a concrete or plastic moulded part, and a sealing profile embedded therein according to the invention. Preferably, the sealing arrangement according to the invention comprises at least two moulded parts according to the invention, wherein the moulded parts lie together with the profile-back faces of their sealing profiles. The at least one moulded part can be, for example, a concrete blade for tunnel construction, a concrete ring for a shaft or a concrete pipe (section), e.g., for sewer or pipeline construction, or a plastic pipe, for example a GRP pipe.

The invention is explained in more detail below on the basis of the attached figures purely for illustrative purposes.

FIG. 1 Schematic illustration of a sealing profile for tubbings embedded in a moulded part according to prior art.

Figure 2:
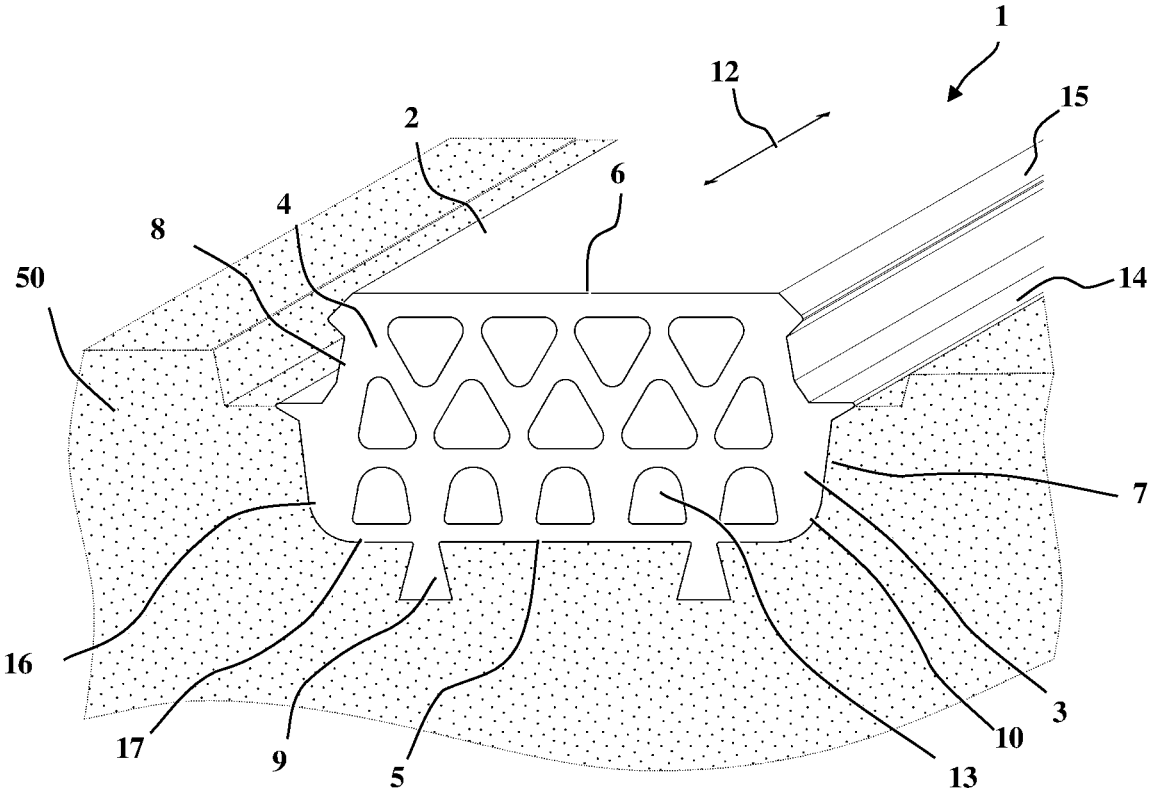

FIG. 2 Schematic illustration of an embodiment of a sealing profile according to the invention, embedded in a moulded part.

Figure 3:
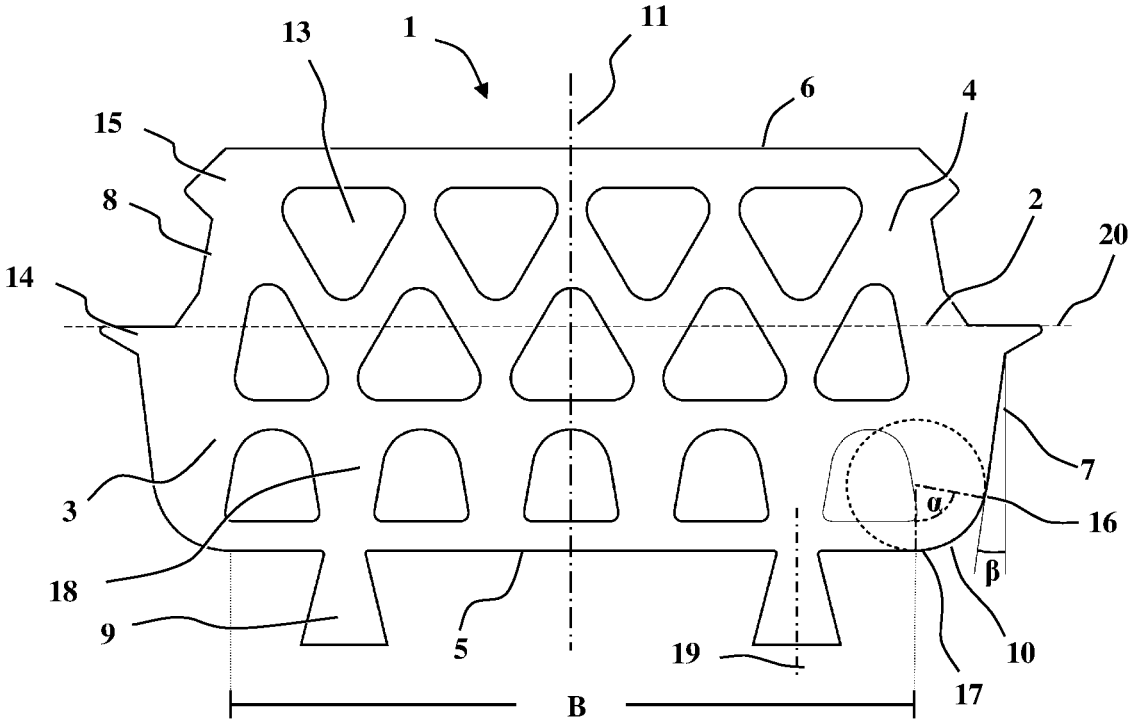

FIG. 3 Cross-section of the embodiment of a sealing profile according to the invention shown in FIG. 2.

Figure 4:
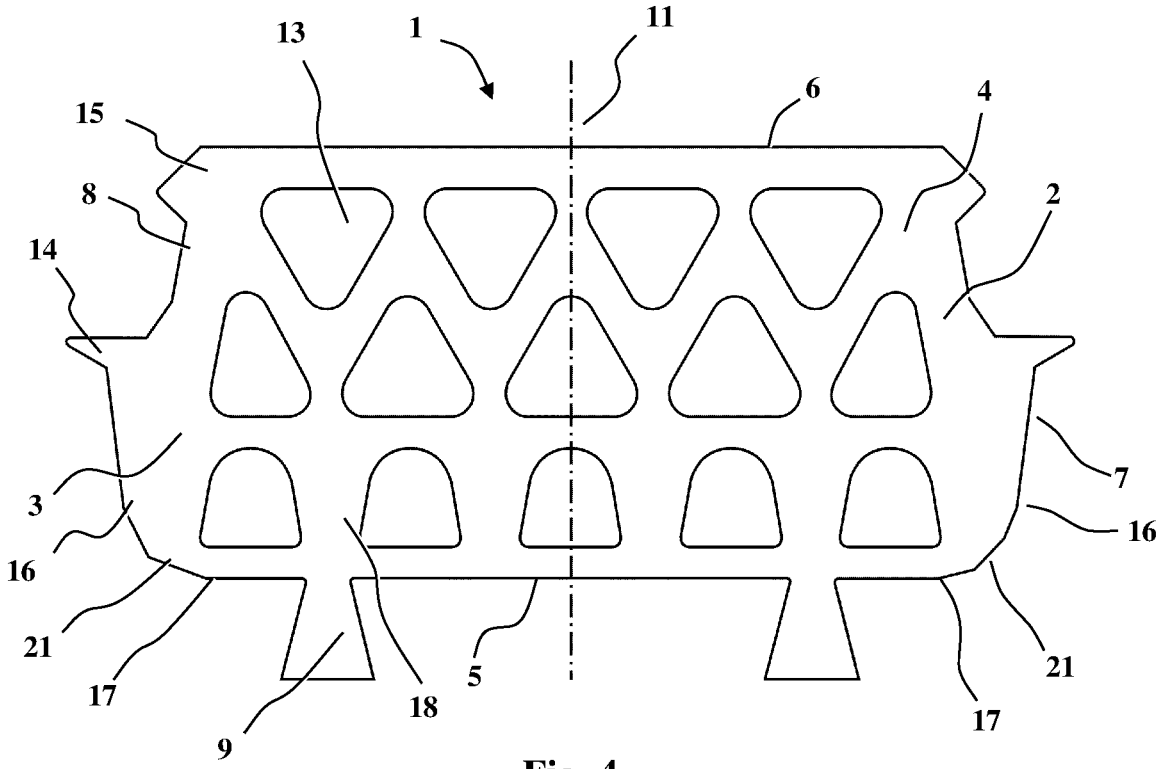

FIG. 4 Cross-section by a further embodiment of a sealing profile according to the invention.

FIG. 1 schematically shows a spatial view of a moulded part 50, here a concrete blade for tunnel constructions, with a sealing profile 101 integrated in it according to prior art. Only one part of the moulded part 50 is shown.

The strand-shaped sealing profile 101 made of elastomer material comprises a generally hexagonal profile body 102 in the cross-section with a profile base 103 facing the moulded part 50 and a profile back 104 projecting from the profile base 103. The profile base face 105 of the profile base 103, which faces the moulded part 50, is opposed by a profile-back face 106 of the profile back 104. The profile body 102 has lateral profile-back flanks 108 and profile base flanks 107. The sealing profile 101 is embedded in the moulded part 50 by means of two generally dovetail-shaped, spaced anchor feet 109 starting from the profile base 103. The anchoring feet 109 are arranged laterally at the outer ends (corners) of the profile base 103. The outer face of the anchoring foot 109 shown here on the left forms the projection of the profile base flank 107 in the direction of moulded part 50; the outer face of the anchoring foot 109 shown in the figure on the right extends at an angle to the corresponding profile base flank 107 in the direction of moulded part 50. The sealing profile 101 comprises cavities running in the longitudinal direction 112 of the sealing profile 101 as longitudinal channels 113. The anchoring feet 109 and the profile base 103 are surrounded by the curable material, here concrete, up to sealing lips 114 on the flank side. A lateral projection 115 on the profile back 104 serves to clip the sealing profile 101 with the profile back 104 into a corresponding recess of a mounting of a formwork mould and to hold it there so that the sealing profile 101 remains directed towards the interior of the formwork mould during the casting process with the anchoring feet 109.

FIG. 2 shows part of an embodiment of a sealing profile 1 according to the invention (see also FIG. 3). The sealing profile 1 according to the invention is embedded in a moulded part 50 made of a curable material. Here, the moulded part 50 is a concrete tubbing for tunnel construction, and the sealing profile 1 correspondingly an integrated in a front side of the tubbing made of an elastomer material, for example, EPDM. The sealing profile 1 can be produced, for example, by means of extrusion. As indicated by the arrow, the strand-shaped sealing profile 1 extends in the longitudinal direction 12. Of the sealing profile 1, only one section is shown, which is cut to the front. The sealing profile 1 has a cross-section generally hexagonal profile body 2 with a profile base 3 and a profile back 4 projecting from the profile base 3. The profile base 3 has a profile base face 5 facing the moulded part 50, the profile back 4 a profile-back face 6 that is opposite the profile base face 5 and essentially parallel to the profile base face 5. The profile-back face 6 forms the sealing face in a sealing arrangement in which, for example, two moulded parts 50 with their sealing profiles 1 embedded into it on the front side with the profile-back faces 6 lie next to each other. The sealing profile 1 has cavities running in the longitudinal direction 12 as longitudinal channels 13, which are arranged here in three planes on top of one another. The sealing profile has lateral profile base flanks 7 and profile-back flanks 8. Projections 15 protrude laterally from the profile body 2, 4 in the area of the profile back, whereby the sealing profile 1 can be held during the casting of the moulded part 50 with the profile back 4 in a correspondingly complementary mounting of a formwork mould. Sealing lips 14 extending laterally from the profile body 2 on level 20 (see FIG. 3) of the transition between profile base 3 and profile back 4 are intended to prevent the penetration of curable material into the mounting of the formwork mould during the casting process of the moulded part 50. Level 20 also indicates the level below which sealing profile 1 is or will be embedded in the moulded part. The sealing profile 1 is anchored here with two anchoring feet 9 expanding in the cross-section in the direction away from the profile base face 5 in a dove-tail-like manner in the cross-section within the moulded part 50. The sealing profile 1 is axisymmetric to a vertical central profile axis 11 in the cross-section on the profile base face 5 and on the longitudinal axis of the sealing profile 1 running in the longitudinal direction 12 (see FIG. 3). For their part, the anchoring feet are each axisymmetric to an axis 19 that is offset in parallel to the central profile axis 11.

The profile base 3 of the sealing profile 1 comprises rounded corners, i.e., the profile base flanks 7 merge with rounded portions 10 into the profile base face 5. As can also be clearly seen from FIG. 3, which shows a cross-section through the embodiment of a sealing profile 1 according to the invention shown in FIG. 2, the profile base flanks 7 in the cross-section in the direction of profile base face 5 run conically towards one another, i.e., they run, viewed in the cross-section, initially in an essentially straight line each to a lateral first transition point 16 closer to the central profile axis 11 on the profile base flank. They form an angle β with a vertical on the profile base face 5 in this linear area, which can be, for example, 5-10°. The rounded portions 10 run, in the cross-section of the sealing profile, from the first transition point 16 in a curved line to the central profile axis 11 perpendicular to the profile base face 5 and, at a second transition point 17, merge into the profile base face 5. In the area of rounded portions 10, in the cross-section in the direction of the profile base face 5, each of the points of the curved arc characterizing the rounded portions in the cross-section is closer to the central profile axis 11. The rounded portions 10 therefore do not jump forward laterally or in the direction of the central profile axis 11 compared to the profile body 2. At the second transition point 17, the rounded portions 10 merge into the profile base face 5, which extends in a straight line in the cross-section, apart from the area with the anchoring feet 9. The length of the curved arc of rounded portions 10 between the transition points 16, 17 is preferably in a relation to the length B of the profile base face 5, each considered in the cross-section, that a sufficiently large-dimensioned rounded portion 10 results. The rounded portions 10 are circular-arc-shaped in the embodiment shown here and the curved arc of the rounded portions 10 extends here over an angle α of about 80°. For example, for a profile with a profile base length B of 40 mm, a suitable circular-arc radius r may be 4 mm. The ratio of the length of the circular arc to the length B of the profile base face (related to a cross-section of the sealing profile, as shown, for example, in FIG. 3) is about 1:7.2. However, depending on the intended use, other embodiments are also possible.

The anchoring feet 9 are inwardly offset in the sealing profile 1 according to the invention in comparison with the sealing profile 101 shown in FIG. 1 from prior art, i.e., in the direction of central profile axis 11. They are each distanced from the second transition points 17, with which the rounded portions 10 of the sealing profile according to the invention 1 merge into the profile base face 5, in the direction of central profile axis 11. In addition, the anchoring feet 9 in this embodiment originate from an area of the profile base face 5, above which a solid bar 18 of elastomer material running vertically through the profile base 3 between hollow longitudinal channels is formed. The rounded corners and the inwardly offset anchoring feet 9 are particularly advantageous to avoid or reduce the spalling observed in sealing profiles 101 from prior art.

FIG. 4 shows by way of example a cross-section of a sealing profile 1 according to the invention with chamfers 21 instead of rounded portions. The chamfers 21, viewed in the cross-section of the sealing profile, run from the first transition point 16 in a polygonal line to the central profile axis 11 perpendicular to the profile base face 5 and merge into the profile base face 5 at the second transition point 17. The chamfers 21 do not protrude laterally from the profile body 2. Here is an example of a sealing profile 1 reproduced, which in this illustration in the cross-section on the left has a chamfer 21 from two individual chamfers, in the cross-section on the right a chamfer 21 from three individual chamfers. In the case of chamfer 21 shown here on the left side, the transition point 16 on the profile base flank 7 is connected to the transition point 17 on the profile base face 5 in the cross-section by a traverse of two linear lines, in the case of the chamfer shown on the right side, the transition points 16, 17 are connected by a traverse from three linear sections. It is possible that there are different embodiments of the corners in the sealing profile 1, for example a different number of chamfers, or on one side a chamfer and on the other side a rounded portion. However, it is preferable if both sides (viewed in the cross-section) are designed to be symmetric to one another.

The invention claimed is:

1. A sealing profile (1) for embedding into a moulded part (50) made of curable material, wherein the sealing profile (1) comprises a profile body (2), with a) a profile base (3) to be embedded within the moulded part (50), which, after embedding the sealing profile (1), comprises a profile base face (5) that faces the moulded part (50); and lateral profile base flanks (7), and b) a profile back (4) projecting from the profile base (3) which comprises a profile-back face (6) opposite the profile base face (5) and lateral profile-back flanks (8), and wherein, the sealing profile (1) has at least one anchoring foot (9) projecting from the profile base face (5), and the profile base flanks (7) merge into the profile base face (5) with rounded portions (10) or chamfers (21), wherein the rounded portions (10) run in the cross-section of the sealing profile (1) from a first transition point (16) in a curved line to a central profile axis (11) perpendicular to the profile base face (5) and, at a second transition point (17), merge into the profile base face (5), or the chamfers (21) run in the cross-section of the sealing profile (1) from a first transition point (16) in a polygonal line to a central profile axis (11) perpendicular to the profile base face (5) on the profile base face (5), and merge into the profile base face (5) at a second transition point (17).

2. The sealing profile (1) according to claim 1, wherein the profile base flanks (7) in the cross-section of the sealing profile (1) run, before their transition into the rounded portions (10) or chamfers (21), a) parallel to each other or b) towards each, in the direction of profile base face (5).

3. The sealing profile (1) according to claim 1, wherein the curved arc of the rounded portions (10) extends across a maximum of 90°.

4. The sealing profile (1) according to claim 1, wherein the curved arc of the rounded portions (10) extends over at least 30°.

5. The sealing profile (1) according to claim 1, wherein the rounded portions (10) in the cross-section of the sealing profile (1) are at least partially circular-arc-shaped.

6. The sealing profile (1) according to claim 1, wherein the ratio of the length of the curved arc of the rounded portions (10) to the length B of the profile base face (5) in the cross-section of the sealing profile (1) is 1:5 to 1:8.

7. The sealing profile (1) according to claim 1, wherein the sealing profile (1) comprises two or more, anchoring feet (9) projecting from the profile base face (5) and distanced away from one another, and wherein the two or more anchoring feet (9) are distanced away from the second transition points (17) of the rounded portions (10) or chamfers (21) in the profile base face (5) in the direction of the central profile axis (11).

8. The sealing profile (1) according to claim 1, wherein the at least one anchoring foot (9) expands in the cross-section of the sealing profile (1) in the direction away from the profile base face (5).

9. The sealing profile (1) according to claim 1, wherein the sealing profile (1) in the cross-section of the sealing profile (1) is axisymmetric with respect to the central profile axis (11).

10. The sealing profile (1) according to claim 1, wherein the sealing profile (1) extends in the longitudinal direction (12) in a strand-shaped manner.

11. The sealing profile (1) according to claim 1, wherein the sealing profile (1) in the profile body (2) comprises longitudinal channels (13).

12. The sealing profile (1) according to claim 1, wherein the profile body (2) has a generally hexagonal cross-section, and wherein two sides of the hexagon are formed of the profile base face (5) and the opposite profile-back face (6), and the remaining sides of the hexagon are formed of the profile base flanks (7) and the profile-back flanks (8).

13. The sealing profile (1) according to claim 1, wherein the sealing profile (1) consists of an elastomer material selected from the group consisting of EPDM, SBR, CR, NBR and TPE, and wherein the elastomer material has a shore hardness of 60-80 type D in accordance with DIN EN ISO 868.

14. The sealing profile (1) according to claim 1, wherein the curable material is a concrete or plastic moulded part.

15. The sealing profile (1) according to claim 1, wherein the profile base flanks (7) in the cross-section of the sealing profile (1) before their transition into the rounded portions (10) or chamfers (21) run in the direction of profile base face (5) towards each other.

16. A moulded part (50) made of curable material, comprising a sealing profile (1) according to claim 1 embedded into the moulded part (50) with the profile base (3).

17. The moulded part (50) according to claim 16, wherein the moulded part (50) is a concrete tubbing for tunnel construction, a concrete ring for shaft constructions, a concrete pipe for sewer or pipeline construction or a plastic pipe.

18. A sealing arrangement, comprising at least one moulded part (50) according to claim 16.

19. A sealing arrangement, comprising at least two moulded parts (50) made of curable material, each of which comprising a sealing profile (1) according to claim 1 embedded into the respective moulded part (50) with the profile base (3), wherein the at least two moulded parts (50) rest on one another with the profile-back faces (6) of their sealing profiles (1).

* * * * *